US005283506A

United States Patent [19]

Hoffmann et al.

[11] Patent Number: 5,283,506

[45] Date of Patent: Feb. 1, 1994

[54] METHOD OF AND APPARATUS FOR REGULATING THE OPERATION OF A DRIVING SYSTEM FOR A PACKING MACHINE

[75] Inventors: Gottfried Hoffmann, Schwarzenbek; Robert Knickrehm, Rethwischdorf, both of Fed. Rep. of Germany

[73] Assignee: Köber AG, Hamburg, Fed. Rep. of Germany

[21] Appl. No.: 893,125

[22] Filed: Jun. 3, 1992

[30] Foreign Application Priority Data

Jun. 4, 1991 [DE] Fed. Rep. of Germany ..... 4118263

[51] Int. Cl.[5] ..... H02P 7/00

[52] U.S. Cl. ..... 318/77; 318/91

[58] Field of Search ..... 318/77, 85, 707, 721, 318/715, 90–93

[56] References Cited

U.S. PATENT DOCUMENTS

| | | | |
|---|---|---|---|
| 3,078,402 | 2/1963 | Mathias et al. | 318/721 |
| 3,621,348 | 11/1971 | Uchida et al. | 318/77 |
| 3,838,321 | 9/1974 | Damm et al. | 318/77 X |
| 4,362,235 | 12/1982 | Erdmann | 198/419 |
| 4,471,866 | 9/1984 | Erdmann | 198/419 |
| 4,503,967 | 3/1985 | Erdmann | 198/419 |
| 4,616,497 | 10/1986 | Wolf | 318/77 X |
| 4,707,643 | 11/1987 | Rohr et al. | 318/77 |
| 4,912,377 | 3/1990 | Bertrand | 318/77 |
| 4,964,501 | 10/1990 | Hoffmann | 198/418 |

FOREIGN PATENT DOCUMENTS 3932795 4/1991 Fed. Rep. of Germany .

*Primary Examiner*—Jonathan Wysocki

*Attorney, Agent, or Firm*—Darby & Darby

[57] ABSTRACT

The operation of a driving system for a cigarette packing machine, wherein the driving system has a rotary main drive and several slave drives electrically connected to the main drive, is controlled in such a way that any selected slave drive can be disconnected from, decelerated to zero speed, accelerated from zero speed to normal speed and reconnected into the drive system in predetermined angular positions of the main drive. Each slave drive transmits motion to one or more movable parts or units of the packing machine in such a way that the movable parts do not clash even though they are movable and do move relative to each other.

27 Claims, 3 Drawing Sheets

METHOD OF AND APPARATUS FOR REGULATING THE OPERATION OF A DRIVING SYSTEM FOR A PACKING MACHINE

BACKGROUND OF THE INVENTION

The invention relates to improvements in methods of and in apparatus for controlling the operation of driving systems for various types of machines, such as packing machines for cigarettes or other articles of the tobacco processing industry. More particularly, the invention relates to improvements in methods of and in apparatus for controlling the operation of driving systems of the type wherein a rotary main drive (e.g., an electric motor) is electrically connected with one or more slave drives (e.g., servomotors) each of which can be used to transmit motion to a discrete movable part, or to a group of movable parts, in a machine. Still more particularly, the invention relates to improvements in methods of and in apparatus for controlling the operation of driving systems wherein the angular position of the rotary main drive is monitored and the operation of the sleve drive or drives is regulated in dependency on the angular positions of the main drive. The invention will be described with reference to packing machines for articles of the tobacco processing industry with the understanding, however, that the improved method and apparatus can be put to use with equal or similar advantage to control the operation of driving systems for other types of machines, for example, machines for packing articles other than those belonging to the tobacco processing industry, paper sheet forming, stacking and wrapping machines and/or others.

A modern cigarette packing machine is equipped with a number of units each of which has one or more movable parts, and such movable parts are called upon to operate in synchronism while moving relative to each other in order to ensure rapid, reliable and predictable gathering of arrays of cigarettes, introduction of arrays into packets, closing and sealing of the packets, application of revenue labels to the closed and sealed packets, confinement of labelled packets in envelopes of light transmitting plastic material, confinement of groups of packets in cartons and introduction of cartons into boxes for storage or for transport to customers. It is important to ensure that the movable parts will not clash and thus damage each other because any, even short-lasting, stoppage of a modern high-speed packing machine would entail huge losses in output. Furthermore, stoppage of a modern packing machine necessitates stoppage of all other machines in a complete production line which further increases the losses. Therefore, it is important to ensure that the various movable parts of a cigarette packing machine are free to move relative to each other, that such parts are operated in synchronism to guarantee that the machine can turn out large numbers of high-quality packets, cartons and boxes per unit of time, as well as that the moving parts are operated by a compact driving system which can accurately determine the times of operation and idleness of various movable parts.

Examples of movable parts which are utilized in a cigarette packing machine are endless belt conveyors, endless chain conveyors, indexible turret conveyors, prongs, pushers, jaws, tongs, plungers, folding fingers and many others. In certain packing machines, all or a large majority of such movable parts receive motion from a main drive through the medium of transmissions which are operated by the main drive and transmit rotary, reciprocatory and/or other movements to the respective discrete movable parts or groups of movable parts. The transmissions can be used to impart to the respective parts continuous or intermittent, regular or irregular movements, either directly or by utilizing cam and follower units.

It is also known to employ in a cigarette packing machine a driving system wherein a main drive (such as a rotary electric motor) drives a plurality of slave drives and each slave drive transmits motion to one or more movable parts of the machine. The connection between the main drive and the slave drives can be of the type known as an electric or electronic shaft which is preferred in many instances because it ensures that the slave drives are operated in exact synchronism with the main drive when such mode of operation is desirable or advantageous.

A drawback of presently known driving systems of the just outlined character (i.e., systems employing a main drive and a set of slave drives which are electrically connected to the main drive) is lack of sufficient flexibility. Such conventional driving systems operate quite satisfactorily as long as the operation of one or more slave drives need not be interrupted or otherwise altered. On the other hand, it is often necessary to interrupt the operation of one or more slave drives, for example, in order to rapidly or immediately segregate defective arrays of cigarettes so that the defective arrays are expelled prior to undergoing any, or prior to undergoing extensive, additional treatment including introduction into packets, closing and sealing of packets containing defective arrays of cigarettes, the application of revenue labels to closed and sealed packets which contain defective arrays of cigarettes, and so on.

OBJECTS OF THE INVENTION

An object of the invention is to provide a novel and improved method of controlling the operation of a driving system wherein a main drive is electrically connected with one or more slave drives.

Another object of the invention is to provide a method which renders it possible to individually control each slave drive independently of each other slave drive.

A further object of the invention is to provide a driving system wherein any selected slave drive can be deactivated and reactivated in such a way that the operation of the reactivated slave drive is invariably synchronized with the operation of each other slave drive and of the main drive to thus avoid damage to parts or groups of parts which receive motion from the slave drive or drives.

An additional object of the invention is to provide a novel and improved method of timing the disengagement, stoppage, acceleration and reengagement of one or more slave drives in a driving system wherein the slave drive or drives is or are electrically connected with a common rotary main drive, such as the prime mover of a packing machine for cigarettes or other articles of the tobacco processing industry.

Still another object of the invention is to provide a method of controlling the operation of a driving system for a cigarette packing machine in such a way that defective commodities can be segregated from satisfactory commodities immediately upon detection.

An additional object of the invention is to provide a novel and improved apparatus for the practice of the above outlined method.

Another object of the invention is to provide the apparatus with novel and improved means for permitting and effecting disturbance-free disconnection of one or more slave drives from a driving system employing a main drive which is normally electrically connected with the slave drive or drives.

A further object of the invention is to provide a machine, such as a packing machine for cigarettes or other articles of the tobacco processing industry, which embodies an apparatus of the above outlined character.

Still another object of the invention is to provide a novel and improved driving system for use in the above outlined apparatus.

An additional object of the invention is to provide the apparatus with novel and improved controls which ensure repeated predictable disengagement and reengagement of one or more slave drives with other constituents of the driving system.

SUMMARY OF THE INVENTION

One feature of the present invention resides in the provision of a method of controlling the operation of a driving system wherein at least one slave drive is normally operated at a predetermined speed by and in a predetermined relation to and is electrically connected with a rotary main drive. The improved method comprises the steps of monitoring the angular position of the main drive, disconnecting the at least one slave drive from the driving system including braking and thereupon arresting the at least one slave drive in predetermined angular positions of the main drive, accelerating the arrested at least one slave drive to the predetermined speed, and reconnecting the thus accelerated at least one slave drive with the driving system.

The method further comprises the step of transmitting motion from the at least one slave drive to at least one movable part of a machine, particularly a machine for packing cigarettes or other articles of the tobacco processing industry.

The braking step can comprise initiating deceleration of the at least one slave drive from the predetermined speed in a first predetermined angular position of the main drive, and the arresting step can comprise bringing the at least one slave drive to a halt in a second predetermined angular position of the main drive. The accelerating step of such method can comprise initiating acceleration of the at least one slave drive from zero speed in a predetermined third angular position of the main drive and the reconnecting step preferably takes place in a predetermined fourth angular position of the main drive. The third angular position of the main drive can be ascertained as a function of the fourth angular position, the position of the arresting at least one slave drive, and at least one in-line parameter of the machine. The at least one parameter can constitute the variable speed of the main drive which can serve as a prime mover of the machine.

If the method comprises the step of transmitting motion from the at least one slave drive to at least one movable part of a machine, e.g., a machine for processing a series of commodities such as arrays of cigarettes, the method can further comprise the steps of monitoring the condition of commodities and generating signals upon detection of commodities exhibiting particular characteristics (such as defects), and utilizing the thus generated signals to initiate the braking step in the corresponding predetermined angular position of the main drive.

The accelerating step preferably begins in a further predetermined angular position of the main drive, and such method can further comprise the steps of transmitting motion from the at least one slave drive to at least one movable part of a machine for the processing of a series of commodities, monitoring the condition of the commodities and generating signals upon detection of commodities exhibiting particular characteristics (e.g., defects), and utilizing the thus obtained signals to initiate at least one of the braking and accelerating steps in the corresponding angular position of the main drive.

The method can further comprise the steps of transmitting motion from the at least one slave drive to at least one movable part of a machine, including imparting to the at least one movable part a predetermined sequence of movements with a transmission receiving motion from the at least one slave drive, and regulating the at least one slave drive in synchronism with the main drive prior to the disconnecting step and subsequent to the reconnecting step.

The method can further comprise the step of regulating the at least one slave drive in synchronism with the main drive prior to the disconnecting step and subsequent to the reconnecting step, the step of transmitting motion from the at least one slave drive to at least one movable part of a machine, and the step of superimposing upon the regulating step a step of imparting to the at least one movable part a predetermined sequence of movements.

Another feature of the invention resides in the provision of an apparatus for controlling the operation of a driving system having at least one slave drive which is normally operated at a predetermined speed by and in a predetermined relation to and is electrically connected with a rotary main drive. The improved apparatus comprises signal generating means for monitoring the angular position of the main drive, means for disconnecting the at least one slave drive from the driving system including means for braking and for thereupon arresting the at least one slave drive in a preselected position in predetermined angular positions of the main drive, means for accelerating the arrested at least one slave drive to the predetermined speed, and means for reconnecting the thus accelerated at least one slave drive with the driving system.

The apparatus further comprises means for transmitting motion from the at least one slave drive to at least one movable part of a machine, such as a machine for packing articles of the tobacco processing industry.

The driving system can comprise a plurality of discrete slave drives and means for transmitting motion from each of the slave drives to one of a plurality of movable parts in a machine (such as a cigarette packing machine) wherein the parts move relative to and cooperate with each other.

The apparatus can further comprise means for memorizing signals denoting first and second angular positions of the main drive, means for comparing signals denoting the monitored angular position of the main drive with the signal denoting the first predetermined angular position of the main drive and for generating additional signals when a signal denoting the monitored angular position of the main drive matches the signal denoting the first predetermined position of the main drive. The disconnecting means can comprise a control unit having means for braking the at least one slave drive in response to an additional signal from the comparing means and for arresting the at least one slave drive in the preselected position when the monitored angular position of the main drive matches the memorized second angular position of the main drive. Such apparatus can further comprise means for memorizing a signal denoting a third predetermined angular position of the main drive, means for calculating and generating signals denoting a fourth angular position of the main drive, and means for comparing signals denoting the monitored angular position of the main drive with the calculated signal denoting the fourth angular position of the main drive and for generating a further signal when the signal denoting the monitored angular position of the main drive matches the calculated signal. The accelerating and reconnecting means can comprise means for accelerating the arrested at least one slave drive when the signal denoting the monitored angular position of the main drive matches the memorized signal denoting the fourth predetermined angular position of the main drive and means for reconnecting the accelerated at least one slave drive with the drive system when the signal denoting the monitored angular position of main drive matches the signal denoting the third predetermined angular position of the main drive.

The apparatus can further comprise means for generating signals denoting the preselected angular position of the at least one slave drive, means for transmitting motion from the at least one slave drive to at least one movable part of a machine, and means for generating signals denoting at least one variable parameter of the machine. The calculating means of such apparatus can include means for computing signals denoting the fourth predetermined angular position of the main drive as a function of memorized signal denoting the third predetermined angular position of the main drive, as a function of signals denoting the preselected position of the at least one slave drive, and as a function of signals denoting the at least one variable parameter of the machine. Such machine can comprise a variable-speed prime mover, and the at least one parameter can constitute the speed of the prime mover. Such prime mover can be constituted by the main drive.

The apparatus of the present invention can be utilized to control the operation of a driving system having first and second slave drives. Such apparatus further comprises means for respectively transmitting motion from the first and second slave drives to first and second movable parts of a cigarette packing machine. The first part can include a first conveyor having receptacles for arrays of cigarettes, and the second part can include at least one second conveyor having means for advancing cigarettes from at least one magazine of the machine into the receptacles of the first conveyor.

Alternatively, the improved apparatus can be utilized to control the operation of a driving system having first, second and third slave drives, and such apparatus further comprises means for respectively transmitting motion from the first, second and third slave drives to first, second and third movable parts of a cigarette packing machine wherein the first movable part comprises a first conveyor having receptacles for arrays of cigarettes, the second movable part comprises an indexible turret having pockets for arrays of cigarettes, and the third movable part comprises a second conveyor having means for transferring arrays of cigarettes from the receptacles of the first conveyor into the pockets of the indexible turret.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
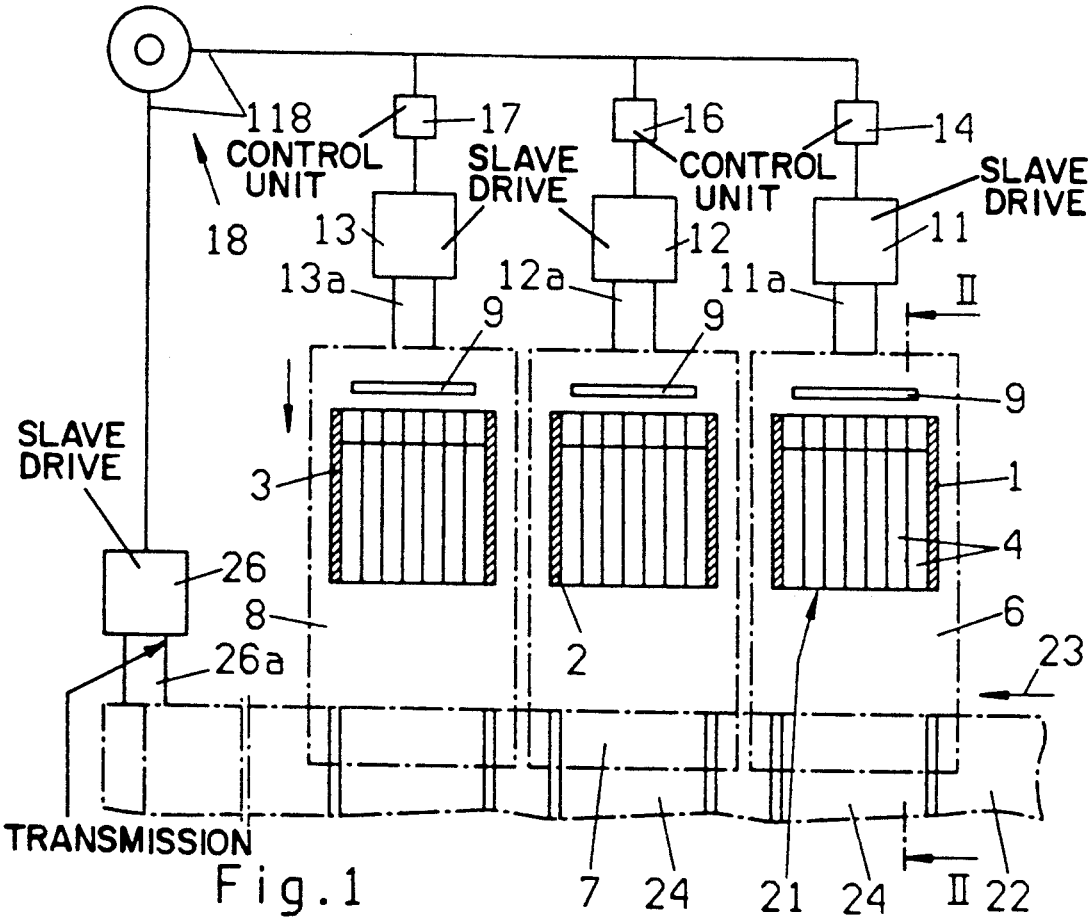
FIG. 1 is a fragmentary schematic partially plan and partially horizontal sectional view of a cigarette packing machine wherein four movable parts or units receive motion from four discrete slave drives each of which is electrically connected with a rotary main drive.
Figure 2:
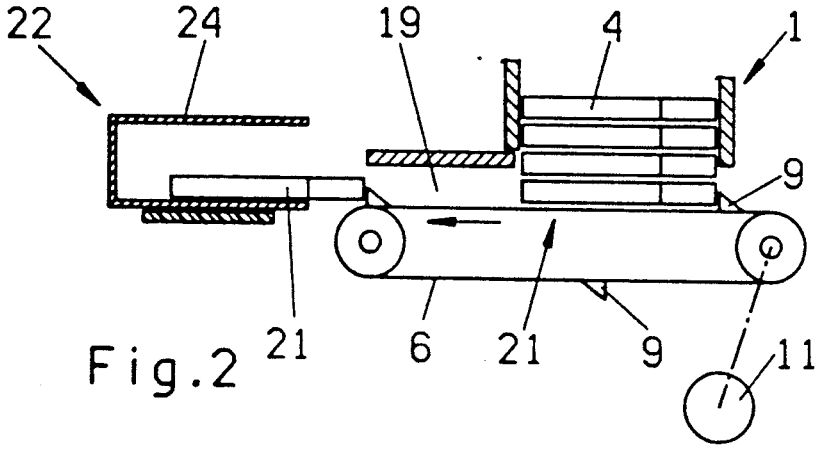
FIG. 2 is a fragmentary vertical sectional view substantially as seen in the direction of arrows from the line II—II in FIG. 1.

Referring first to FIGS. 1 and 2, there is shown a driving system with a rotary main drive 18 and four secondary or slave drives 11, 12, 13 and 26. The driving system is installed in or is combined with a cigarette packing machine which comprises three ducts 1, 2, 3 forming part of a magazine for filter cigarettes 4. The ducts 1, 2, 3 respectively cooperate with three discrete endless belt conveyors 6, 7, 8 which serve to transfer layers 21 of parallel cigarettes 4 into successive receptacles or compartments 24 of an endless belt or chain conveyor 22. The conveyors 6 to 8 are provided with pushers in the form of strips 9 which serve to advance successively gathered layers 21 of cigarettes 4 from the respective ducts 1 to 3 into the registering receptacles 24 of the conveyor 22. The slave drives 11, 12, 13 respectively transmit motion to the conveyors 6, 7, 8, and the connection between the slave drives 11, 12, 13 and the main drive 18 comprises control units 14, 16, 17, respectively, and a so-called electric shaft 118.

If the receptacles 24 of the conveyor 22 are to gather arrays 29 (FIGS. 3 and 4) each of which contains twenty parallel filter cigarettes 4, the duct 1 serves to gather successive layers 21 each of which contains seven closely adjacent parallel cigarettes 4, the duct 2 gathers successive layers 21 each of which contains six closely adjacent parallel cigarettes 4, and the duct 3 gathers successive layers 21 each of which contains seven closely adjacent parallel cigarettes 4. This results in the assembly of so-called quincunx formations of the type customarily found in packets of twenty cigarettes each. The cigarettes 4 of the median layer 21 (six cigarettes) are staggered with reference to the cigarettes of the two outer layers 21 (seven cigarettes each). If the packets are to contain arrays of twentyone cigarettes, the number of cigarettes 4 in the layers 21 gathered by the median duct 2 is the same as that in the layers 21 which are gathered by the ducts 1 and 3.

The path of movement of the upper reach of the endless conveyor 22 and its receptacles 24 extends at right angles to the paths of movement of the upper reaches of the belt conveyors 6, 7 and 8. The direction of advancement of the upper reach of the conveyor 22 is indicated in FIG. 1 by arrow 23. The outlets 19 of the ducts 1, 2 and 3 are disposed at different levels, and the differences between neighboring levels equal or approximate the diameter of a cigarette 4. Such positioning of the three outlets 19 (only one shown in FIG. 2) ensures that the (first) layer 21 which is delivered by the conveyor 6 is deposited on the bottom wall of the registering receptacle 24, that the second layer 21 (delivered by the conveyor 7) comes to rest on top of the first layer, and that the third layer 21 (delivered by the conveyor 8) comes to rest on top of the second layer in the respective receptacle 24.

Reference may be had to commonly owned U.S. Pats. Nos. 4,462,235 (granted Dec. 7, 1982 to Erdmann), 4,471,866 (granted Sept. 18, 1984 to Erdmann et al.) and 4,503,967 (granted Mar. 12, 1985 to Erdmann et al.).

In normal operation of the packing machine, the slave drives 11, 12, 13 for the respective conveyors 6, 7 and 8 are continuously driven by the main drive 18 through the respective control units 14, 16 and 17. The slave drive 26 serves to intermittently drive the conveyor 22. The velocity profiles of the conveyors 6, 7 and 8 are selected with a view to ensure gentle treatment of cigarettes 4 by the pushers 9 during expulsion through the respective outlets 19 and during introduction into the registering receptacle 24 (see FIG. 2). The operation of the driving system including the main drive 18 and the servo drives 11, 12, 13, 26 is such that the conveyor 22 is at a standstill when three of its chambers 24 receive layers 21 of cigarettes 4 from the neighboring ducts 1, 2, 3, and the slave drive 26 thereupon indexes the conveyor 22 by a step (in the direction of arrow 23) when the introduction of three layers 21 from three different outlets 19 is completed and while the pushers 9 of the conveyors 6, 7, 8 are in the process of expelling fresh layers 21 from the respective ducts 1, 2, 3 preparatory to introduction of such layers into the next receptacles 24 while the conveyor 22 is again at a standstill. Thus, the apparatus (including the units 14, 16, 17) which controls the operation of the slave drives 11–13 and 26 ensures that the parts 9 of the packing machine do not collide with the parts 24. Such collision could result in damage to the packing machine which would invariably necessitate prolonged interruption of operation with attendant huge losses in output. A modern cigarette making machine (which delivers cigarettes 4 to the magazine including the ducts 1–3) can turn out as many as 10,000 cigarettes per minute so that losses due to an even short-lasting interruption of operation of the packing machine are very pronounced.

The slave drives 11, 12, 13 operate in synchronism with the main drive 18 and can be directly connected to the respective conveyors 6, 7, 8 or they can transmit motion to such conveyors by way of suitable transmissions (shown schematically at 11*a*, 12*a* and 13*a*). For example, the transmissions 11, 12*a*, 13*a* can include or constitute suitable stepping drives such as geneva movements, planetaries, cam-and-follower drives and/or others. The selection of transmissions depends upon the nature of movement which is to be performed by the part or parts receiving motion from a slave drive. In the case of the endless belt conveyors 6, 7 and 8 which need not be arrested in normal operation of the packing machine, a velocity control can be superimposed upon the controls which are effected by the units 14, 16 and 17 to ensure operation in synchronism with the main drive 18. Such imposition of velocity controls can ensure that the movements of the conveyors 6–8 and their pushers 9 are properly timed relative to the movements of the conveyor 22.

An apparatus which is similar to that shown in FIGS. 1 and 2 is described and shown in commonly owned U.S. Pat. No. 4,964,501 granted Oct. 23, 1990 to Hoffmann et al. for "Apparatus for transferring layers of rod-shaped articles in packing machines". The disclosure of this patent is incorporated herein by reference.

Figure 3:
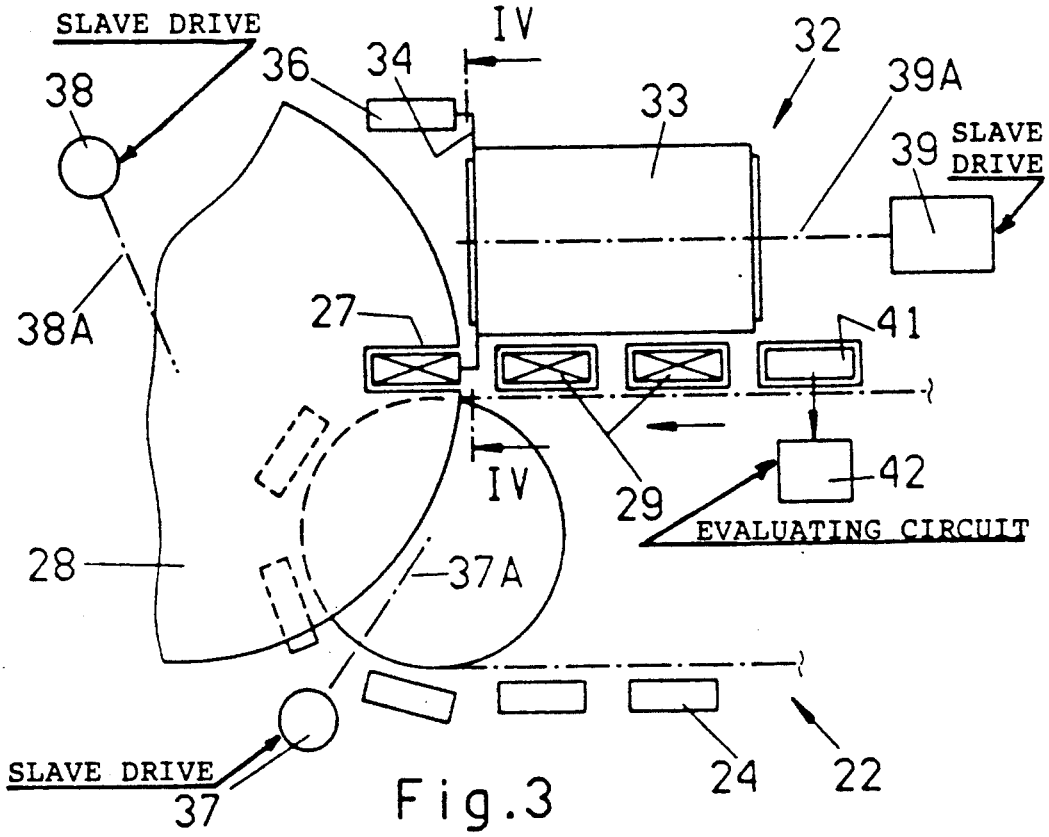
FIG. 3 is a fragmentary schematic front elevational view of another portion of a cigarette packing machine wherein three discrete slave drives transmit motion to three discrete movable parts or units.
Figure 4:
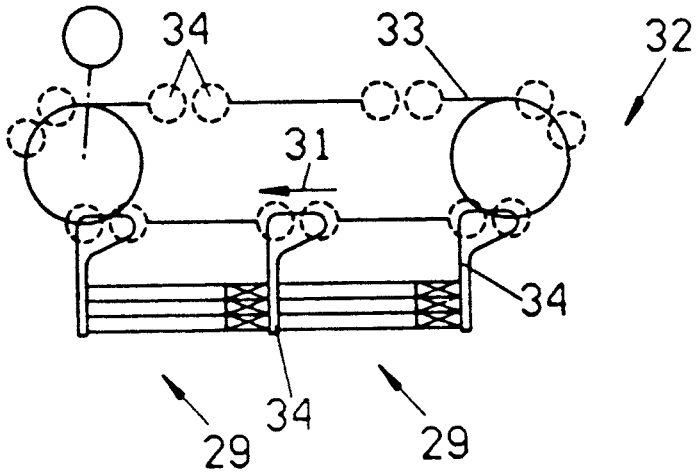
FIG. 4 is a fragmentary vertical sectional view substantially as seen in the direction of arrows from the line IV—IV in FIG. 3.

FIGS. 3 and 4 illustrate that portion of a packing machine wherein fully assembled arrays 29 of cigarettes are transferred from the receptacles 24 of the conveyor 22 into the pockets 27 of a further conveyor in the form of a turret 28 which is indexible about a horizontal axis. The means 32 for transferring arrays 29 from successive receptacles 24 into successive pockets 27 comprises a further endless conveyor 33 having arms 34 for plate- or vane-like pushers 36 which can engage the end faces of cigarettes forming arrays 29 and advance the arrays in the axial direction of the respective cigarettes into the registering pockets 27 of the turret 28 which is then at a standstill, the same as the conveyor 22. The direction of advancement of cigarettes forming the arrays 29 during transfer from their receptacles 24 into the registering pockets 27 is indicated by arrow 31. FIG. 4 further shows that the end faces of cigarettes forming an array 29 are held between two neighboring pushers 36 during expulsion from their receptacles 24. The path along which the arrays 29 advance from the receptacles 24 into the registering pockets 27 is a straight path. When the conveyor 33 is brought to a halt, two of its pushers 36 flank the pocket 27 which has just received an array 29. Thus, and since the pushers 26 do not extend into a pocket 27 when the conveyor 33 is idle, the turret 28 can be indexed to advance the freshly filled pocket 27 by a step while simultaneously advancing an empty pocket 27 to a position for reception of an array 29 from the conveyor 22. A structure of the type shown in FIGS. 3 and 4 is disclosed, for example, in commonly owned published German patent application No. 39 32 795 to which reference may be had, if necessary.

The driving system which transmits motion to the conveyors 22, 33 and turret 28 of FIGS. 3 and 4 comprises a main drive (such as the main drive 18 of FIG. 1), a slave drive 37 (corresponding to the slave drive 26 of FIG. 1) for the conveyor 22, a slave drive 38 for the turret 27 and a slave drive 39 for the conveyor 33. The slave drives 37–39 are operated in synchronism with the main drive 18 (see FIGS. 5 and 6 which show the main drive 18 and the slave drive 39). Movements which the slave drives 37–39 of FIGS. 3 and 4 transmit to the respective movable parts or units of the packing machine including the structure of FIGS. 3 and 4 can include suitable transmissions 37A, 38A, 39A but preferably also an apparatus (43 in FIG. 6) which controls the operation of the driving system including the main drive 18 and its associated slave drives 37–39. The controls for the slave drives 37–39 are superimposed upon the means for synchronizing the movements of the slave drives with that of the main drive. This renders it possible to disconnect selected slave drives from the driving system including the main drive 18, to decelerate (brake) and arrest a disengaged slave drive, to thereupon accelerate the disengaged, braked and arrested slave drive to a predetermined speed which is best suited for operation in synchronism with the main drive, and to reengage the thus accelerated slave drive with the driving system without risking damage to parts which receive motion from the thus controlled slave drives. As mentioned above, the parts which receive motion from the slave drives move relative to but in synchronism with each other, and such movements must be controlled with a view to avoid clashing of intermeshing or interengaging parts at each and every stage of operation of the packing machine. For example, the slave drives 37, 38 can index the conveyor 22 and the turret 28 in exact synchronism with each other (by advancing them through distances such that an empty pocket 27 is in an optimum position to receive a full array 29 of cigarettes from the adjacent receptacle 24). At such time, the conveyor 33 of the transferring means 32 is at a standstill. Inversely, the turret 28 and the conveyor 22 are idle when the slave drive 39 compels the conveyor 33 to cause one of its pushers 36 to transfer a full array 29 from a stationary filled receptacle 24 into the adjacent stationary empty pocket 27.

FIG. 3 further shows a monitoring device 41 which is adjacent the path of movement of filled receptacles 24 and serves to determine certain particular characteristics (such as defects) of the arrays 29 of cigarettes on their way from the last or third conveyor (6) and the corresponding duct (3) of FIG. 1 toward the station for the transfer of arrays 29 from the conveyor 22 into the pockets 27 of the turret 28. For example, the monitoring device 41 can comprise an arrangement of diodes which are designed to ascertain the number of cigarettes 4 in an array 29 and/or the orientation of cigarettes in an array 29 relative to each other and relative to the walls of the respective receptacle 24 and/or the condition of tobacco-containing ends (or filter tipped ends) of filter cigarettes in successive arrays 29, i.e., in successive receptacles 24 of the conveyor 22. The output of the monitoring device 41 transmit signals (which denote the monitored characteristics of the arrays 29) to an evaluating circuit 42 (shown twice in FIG. 6) which, in turn, transmits corresponding signals to the computer 49 or 53 of the apparatus 43 of FIG. 6.

It is desirable to immediately detect defective articles in a packing machine, or to detect the defective articles (either individually or in the form of arrays) as soon as possible. This enables the machine to expel or discharge the defective articles before they undergo extensive additional treatment (e.g., introduction into packets, labelling of packets which contain defective articles, and so on) with attendant savings in other materials such as those used for the making of blanks, revenue labels, transparent envelopes and tear strips for filled, closed and sealed packets, and others. The just discussed segregation or expulsion of defective articles (arrays 29) can be carried out with the apparatus 43 of the type shown in FIG. 6. The apparatus 43 of FIG. 6 serves to regulate the operation of a driving system which comprises a main drive 18, a single slave drive 29 and an electric shaft 118 (FIG. 5); however, it is equally possible to utilize the illustrated apparatus 43 or an analogous apparatus to control the operation of a driving system wherein the main drive is electrically connected with two, three or more slave drives, e.g., with the slave drives 37, 38 and 39 of FIG. 3.

Figure 5:
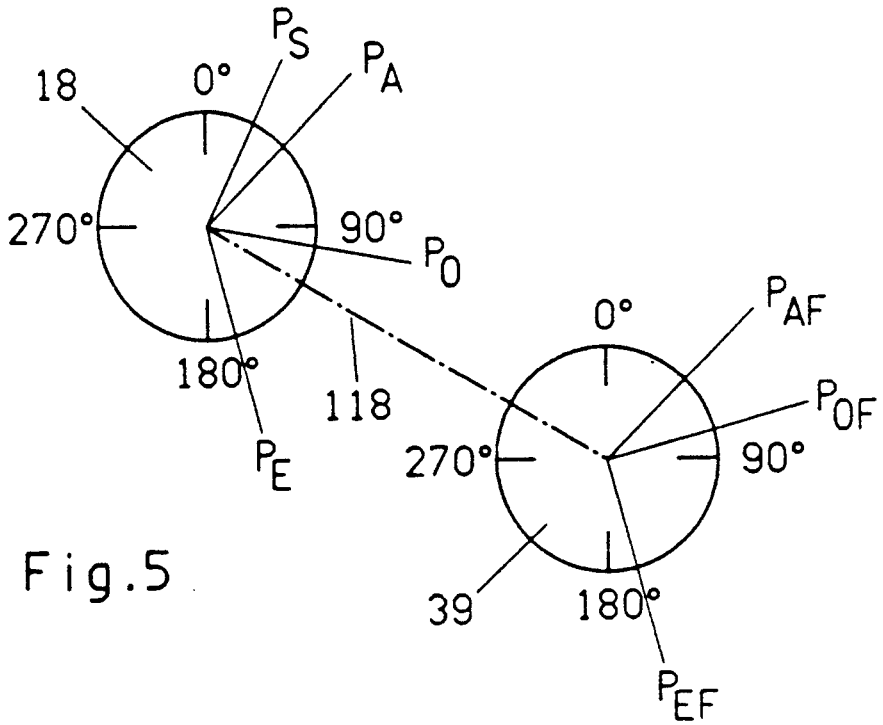
FIG. 5 is a schematic view of an electrical connection between the main drive and one of the slave drives in the packing machine of FIGS. 3-4.
Figure 6:
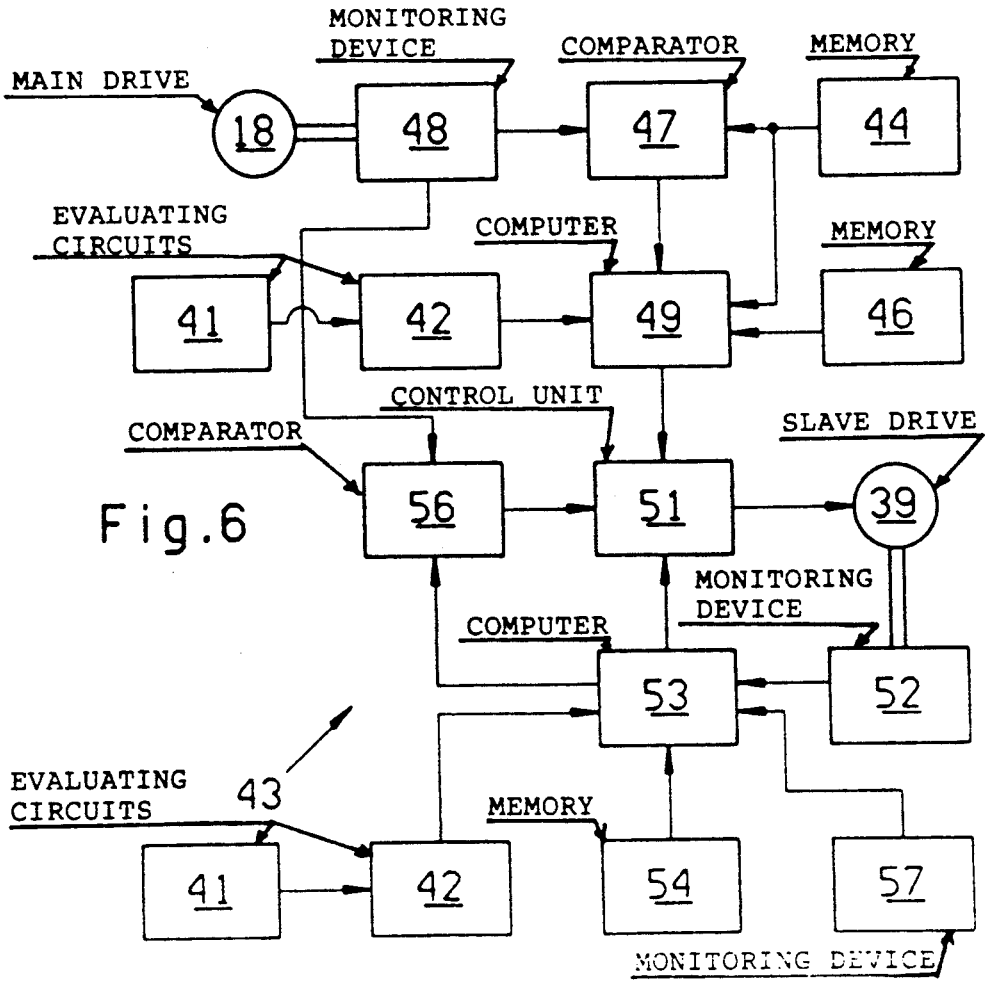
FIG. 6 is a block diagram of an apparatus which controls the operation of a driving system including the main drive and the slave drive of FIG. 5.

The apparatus 43 of FIG. 6 comprises memories 44 and 46 for storage of information (signals) denoting two predetermined angular positions of the rotary main drive 18, namely a first predetermined angular position $P_A$ (memory 44) which is shown in FIG. 5, and a second predetermined angular position $P_O$ (memory 46) which is also shown in FIG. 5. The output of the memory 44 is connected with a comparator 47 which further receives signals from a signal generating monitoring device 48 associated with the main drive 18 and serving to transmit signals denoting the actual angular position of the drive 18. The outputs of the memory 44 and comparator 47 are connected to the corresponding inputs of the computer 49 which further receives second signals from the memory 46 and serves to calculate a further angular position $P_S$ of the main drive 18 and transmits corresponding signals to a control circuit or unit 51. The purpose of the control circuit 51 is to transmit signals for disengagement of the slave drive 39 from and for reengagement of the slave drive 39 with the driving system including the main drive 18 as well as for deceleration (braking) and acceleration of the slave drive.

A further monitoring device 52 is provided to transmit signals denoting the position of the slave drive 39. The output of the monitoring device 52 transmits signals denoting the position of the slave drive 39 to one input of the second computer 53 having one of its outputs connected to the control unit 51. Another input of the computer 53 receives signals from a memory 54 for storage of signals denoting a fourth angular position $P_E$ of the main drive 18 (see FIG. 5). A further input of the computer 53 is connected with the output of a device 57 for transmission of signals denoting at least one monitored parameter of the packing machine and/or of the articles which are being processed therein. The monitoring device 57 can transmit signals denoting changes in the speed of the prime mover (such as the main drive 18) of the packing machine. Another output of the computer 53 is connected with one input of a comparator 56 which further receives signals from the monitoring device 48 and transmits signals to the corresponding input of the control unit 51.

The monitoring device 57 of FIG. 6 can constitute or include, or can be replaced by, the evaluating circuit 42 of FIG. 3. Still further, the monitoring device 57 can include or can be connected with or can be replaced by the monitoring device 52.

The mode oaf operation of the apparatus 43 of FIG. 6 will be described with reference to those movable parts of the packing machine which are shown in FIGS. 3 and 4. As already mentioned above, the apparatus 43 of FIG. 6 controls the operation of a single slave drive 39; however, such apparatus can be used with equal advantage to control the operation of a driving system wherein a main drive (18) is electrically connected (e.g., by means of the so-called electric or electronic shaft 118) with two or more slave drives (such as the slave drives 37–39 of FIG. 3).

When the operation of the packing machine is satisfactory, the operation of the slave drive 39 is synchronized with that of the rotary main drive 18. This can be seen in FIG. 5 wherein the electrical connection 118 between the drives 18 and 39 is indicated by a phantom line. The angular position of the slave drive 39 is the same as that of the main drive 18 during each stage of normal operation of the packing machine. The slave drive 39 transmits motion to the corresponding movable part or parts (transfer conveyor 33 and its arms 34 and pushers 36 shown in FIG. 3) of the packing machine by way of a suitable motion transmitting means (transmission) denoted in FIG. 3 by a phantom line 39A. A transmission (such as 39*a* or an equivalent motion transmitting means) can be installed between the main drive 18 and each and every slave drive (i.e., including the slave drives 37 and 38 of FIG. 3). The corresponding transmissions are indicated in FIG. 3, as at 37A and 38A. Reference may also be had again to FIG. 1 which shows the transmissions 11*a*, 12*a*, 13*a* between the slave drives 11, 12, 13 and the respective conveyors 6, 7, 8. A further transmission 26*a* is provided in FIG. 1 between the slave drive 26 and the conveyor 22.

If the monitoring device 41 and the associated evaluating circuit 42 of FIG. 3 detect the presence of a defective array 21, such array is to be expelled from the respective receptacle 24 (rather than being transferred into the oncoming pocket 27) as expeditiously as possible. For example, the defective array 29 is to bypass the transfer station between the conveyor 22 and turret 24 to be expelled from the respective receptacle 24 during advancement with the lower reach of the conveyor 22. This necessitates temporary interruption of operation of the transfer conveyor 33, i.e., temporary disconnection of the slave drive 39 from the driving system including the main drive 18. In other words, one cycle of the packing machine should not result in transfer of an array 29 from the conveyor 22 into the turret 28.

The memory 44 of the apparatus 43 stores a signal denoting the first angular position $P_A$, and the memory 46 stores a signal denoting the second angular position $P_O$ of the main drive 18. The memory 54 stores a signal denoting the fourth angular position $P_E$ of the main drive 18. These angular positions, as well as a third angular position $P_S$, of the main drive 18 are shown in FIG. 5. The computer 49 of the apparatus 43 is programmed in such a way that it transmits to the control unit 51 for the slave drive 39 a signal to proceed with deceleration (braking) of the slave drive 39 when the main drive 18 reaches the angular position $P_A$, i.e., when the signal transmitted by the monitoring device 48 matches the signal which is stored in the memory 44. Such identity of the two signals is ascertained by the comparator 47 which receives signals from the monitoring device 48 as well as from the memory 44 and transmits signals to the computer 49. The computer 49 transmits a signal to the control unit 51 for the slave drive 39 when it receives a signal from the defect monitoring device 41, i.e., from the evaluating circuit 42.

Since the computer 49 is also connected with the output of the memory 46, it receives a signal denoting the second angular position $P_O$ of the main drive 18, and this enables the computer 49 to calculate the interval which is required to decelerate the slave drive 39 to zero speed, i.e., to a complete standstill. The slave drive 39 is brought to a standstill at the exact instant when the main drive 18 reaches the second angular position $P_O$. The computed signal denoting full stoppage of the slave drive 39 is transmitted from the computer 49 to the unit 51 which directly controls the slave drive 39. That angular position of the slave drive 39 in which the latter begins to undergo a braking (decelerating) action is shown in FIG. 5 at $P_{AF}$, and such position corresponds to the first angular position $P_A$ of the main drive 18. The (preselected) angular position $P_{OF}$ of FIG. 5 is that position of the slave drive 39 in which the latter is brought to a full stop, and this position corresponds to (but does not match) the second position $P_O$ of the main drive 18. At such time, the slave drive 39 is disengaged from the driving system including the main drive 18, and its position ($P_{OF}$) of standstill is known. Stoppage of the slave drive 39 for the duration of a machine cycle ensures that the transfer conveyor 33 is idle and cannot transfer the defective array 29 from the corresponding receptacle 24 of the conveyor 22 into the oncoming empty pocket 27 of the turret 28.

If the next array 29 is satisfactory, the evaluating circuit 42 receives a corresponding signal from the monitoring device 41 and transmits information to the computer 53 which also receives a signal denoting the position $P_{OF}$ of the slave drive 39 (this drive is idle). Signals from the evaluating circuit 42, from the monitoring device 52 (position $P_{OF}$ of the slave drive 39), a predetermined acceleration program which is stored in the computer 53, and a machine parameter are processed in the computer 53 to calculate the third angular position $P_S$ of the main drive 18. The computer 53 then transmits a thus calculated signal to the control unit 51 which starts the accelerating step for the slave drive 39 at the exact instant when the main drive 18 reaches the third angular position $P_S$. The aforementioned machine parameter (monitored at 57) can constitute the speed of the packing machine (i.e., the speed of the main drive 18 if the latter constitutes the main prime mover of the packing machine). It will be noted that the output of the monitoring device 57 for one or more variable parameters of the packing machine is connected to the corresponding input of the computer 53 which determines the third angular position $P_S$ and hence the start of acceleration of the slave drive 39 from zero speed (i.e., from the angular position $P_{OF}$). The slave drive 39 is accelerated to a predetermined speed (at which it can be operated in synchronism with the main drive 18) when the main drive reaches the fourth angular position $P_E$. The comparator 56 compares the actual angular position of the main drive 18 (signal from the monitoring device 48) with the third angular position $P_S$ (signal transmitted by the computer 53) and causes reconnection of the slave drive 39 with the driving system including the main drive 18 when the main drive reaches the fourth angular position $P_E$ corresponding to the position $P_{EF}$ of the slave drive. As shown in FIG. 5, acceleration of the slave drive 39 begins (from the position $P_{OF}$) when the main drive 18 reaches the third position $P_S$, and the acceleration of the slave drive is completed when the slave drive reaches the position $P_{EF}$ corresponding to the fourth angular position $P_E$ of the main drive 18. From then on, the operation of the slave drive 39 is again synchronized with that of the main drive 18, i.e., the next (satisfactory) array 29 is again transferred from its receptacle 24 into the aligned pocket 27 of the turret 28 because the transmission 39A of FIG. 3 is effective to transmit motion from the slave drive 39 to the transfer conveyor 33 and its pushers 36.

An important advantage of the improved apparatus 43 and method is that they ensure exact synchronization in phase and timing of movements of the main drive 18 with those of the slave drive 39. This prevents clashing of cooperating movable parts of the packing machine and thus eliminates the likelihood of damage to such movable parts and/or to other parts of the machine. Furthermore, the likelihood of prolonged idleness of the machine as a result of damage to its moving parts is very remote and the output of the machine is increased accordingly. The slave drive 39 can be disengaged from and reengaged with the driving system, including the main drive 18, as often as necessary.

Another important advantage of the improved method and apparatus is that the disengagement, deceleration, acceleration and reengagement of the slave drive or drives are also properly related to the operation of the main drive 18, i.e., they are dependent upon predetermined angular positions of the rotary part or parts of the main drive, e.g., a variable-speed electric motor. Since the just outlined mode of operation of the improved apparatus ensures that the position $P_{OF}$ of a slave drive is known, the computer 53 can readily calculate the angular position $P_S$ of the main drive 18 and hence the timing of start of acceleration of a slave drive preparatory to reconnection with the driving system. It will be seen that the angular position of the main drive 18 controls disengagement, deceleration and stoppage of a slave drive as well as acceleration and reengagement of the arrested slave drive. This invariably ensures that the parts receiving motion from the slave drives in a driving system which is controlled by the improved apparatus will not clash during disengagement, deceleration and stoppage and/or during acceleration and reengagement of a slave drive.

A further important advantage of the improved method and apparatus is that it is possible to impart to the movable parts of a machine any desired sequence or pattern of movements. Thus, a slave drive must be disconnected or disengaged from the driving system only under certain specific circumstances but normally remains connected with the main drive even if the part or parts which receive motion from such slave drive must perform a rather complex sequence of movements. This is ensured by the provision of motion transmitting means between a slave drive and the respective movable part or parts of the machine. Thus, movements which are imparted to one or more movable parts as a result of the provision of a transmission between such movable part or parts and the respective slave drive can be superimposed upon those movements which are imparted to the movable part or parts as a result of operation of the slave drive in synchronism with the main drive.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of controlling the operation of a driving system wherein at least one slave drive is normally operated at a predetermined speed by and in a predetermined relation to and is electrically connected with a rotary main drive; comprising the steps of monitoring the angular position of the main drive; disconnecting the at least one slave drive from the driving system, including braking and thereupon arresting the at least one slave drive in predetermined angular positions of the main drive while the main drive continues to rotate; accelerating the arrested at least one slave drive to said predetermined speed; and reconnecting the thus accelerated at least one slave drive with the driving system.

2. The method of claim 1, further comprising the step of transmitting motion from the at least one slave drive to at least one movable part of a machine for packing articles of the tobacco processing industry.

3. The method of claim 1, wherein said braking step comprises initiating a deceleration of the at least one slave drive from the predetermined speed in a first predetermined angular position of the main drive and said arresting step includes bringing the at least one slave drive to a halt in a second predetermined angular position of the main drive.

4. The method of claim 3, wherein said accelerating step includes initiating acceleration of the at least one slave drive from zero speed in a predetermined third angular position of the main drive and said reconnecting step takes place in a predetermined fourth angular position of the main drive.

5. The method of claim 4, further comprising the steps of transmitting motion from the at least one slave drive to at least one movable part of a machine and ascertaining the third angular position of the main drive as a function of the fourth angular position of the main drive, the position of the arrested at least one slave drive and at least one in-line parameter of the machine.

6. The method of claim 5, wherein said at least one parameter is the speed of the main drive.

7. The method of claim 1, further comprising the steps of transmitting motion from the at least one slave drive to at least one movable part of a machine for the processing of a series of commodities, monitoring the condition of the commodities and generating signals upon detection of commodities exhibiting particular characteristics, and utilizing said signals to initiate said braking step in the corresponding predetermined angular position of the main drive.

8. The method of claim 1, wherein said accelerating step begins in a further predetermined angular position of the main drive and further comprising the steps of transmitting motion from the at least one slave drive to at least one movable part of a machine for the processing of a series of commodities, monitoring the condition of the commodities and generating signals upon detection of commodities exhibiting particular characteristics, and utilizing said signals to initiate at least one of said braking and accelerating steps in the corresponding angular position of the main drive.

9. The method of claim 1, further comprising the steps of transmitting motion from the at least one slave drive to at least one movable part of a machine including imparting to the at least one movable part a predetermined sequence of movements with a transmission receiving motion from the at least one slave drive, and regulating the at least one slave drive in synchronism with the main drive prior to said disconnecting step and subsequent to said reconnecting step.

10. The method of claim 1, further comprising the step of regulating the at least one slave drive in synchronism with the main drive prior to said disconnecting step and subsequent to said reconnecting step, the step of transmitting motion from the at least one slave drive to at least one movable part of a machine, and the step of superimposing upon said regulating step a step of imparting to the at least one movable part a predetermined sequence of movements.

11. Apparatus for controlling the operation of a driving system having a least one slave drive which is normally operated at a predetermined speed by and in a predetermined relation to and is electrically connected with a rotary main drive, comprising signal generating means for monitoring the angular position of the main derive; means for disconnecting the at least one slave drive from the driving system including means for braking and thereupon arresting the at least one slave drive in a preselected position in predetermined angular positions of the main drive while the main drive continues to rotate; means for accelerating the arrested at least one slave drive to said predetermined speed; and means for reconnecting the thus accelerated at least one slave drive with the driving system.

12. The apparatus of claim 11, further comprising means for transmitting motion from the at least one slave drive to at least one movable part of a machine for packing articles of the tobacco processing industry.

13. The apparatus of claim 11 for controlling the operation of a driving system having a plurality of discrete slave drives, further comprising means for transmitting motion from each of the slave drives to one of a plurality of movable parts in a machine wherein said parts move relative to and cooperate with each other.

14. The apparatus of claim 11, further comprising means for memorizing signals denoting first and second predetermined angular positions of the main drive.

15. The apparatus of claim 14, further comprising means for comparing signals denoting the monitored angular position of the main drive with the signal denoting said first predetermined angular position and for generating additional signals when a signal denoting the monitored angular position of the main drive matches the signal denoting said first predetermined angular position of the main drive.

16. The apparatus of claim 15, wherein said disconnecting means comprises a control unit having means for braking the at least one slave drive in response to an additional signal from said comparing means and for arresting the at least one slave drive in said preselected position when the monitored angular position of the main drive matches said memorized second angular position.

17. The apparatus of claim 14, further comprising means for memorizing a signal denoting a third predetermined angular position of the main drive.

18. The apparatus of claim 17, further comprising means for calculating and generating signals denoting a fourth angular position of the main drive.

19. The apparatus of claim 18, further comprising means for comparing signals denoting the monitored angular position of the main drive with the calculated signal denoting said fourth angular position of the main drive and for generating a fourth signal when the signal denoting the monitored angular position matches the calculated signal.

20. The apparatus of claim 19, wherein said accelerating and reconnecting means comprise means for accelerating the arrested at least one slave drive when the signal denoting the monitored angular position of the main drive matches the memorized signal denoting the second predetermined angular position of the main drive and means for reconnecting the accelerated at least one slave drive with the drive system when the signal denoting the monitored angular position of the main drive matches the signal denoting said third predetermined angular position of the main drive.

21. The apparatus of claim 18, further comprising means for generating signals denoting the preselected position of the at least one slave drive, means for transmitting motion from the at least one slave drive to at least one movable part of a machine and means for generating signals denoting at least one variable parameter of the machine, said calculating means including means for computing signals denoting the fourth angular position of the main drive as a function of memorized signal denoting the third predetermined angular position of the main drive, as a function of signals denoting the preselected position of the at least one slave drive and as a function of signals denoting said at least one variable parameter of the machine.

22. The apparatus of claim 21, wherein the main drive constitutes a prime mover of the machine and said at least one variable parameter is the speed of the main drive.

23. The apparatus of claim 21, wherein the machine comprises a variable-speed prime mover and said at least one parameter is the speed of the prime mover.

24. The apparatus of claim 11 for controlling the operation of a driving system having first and second slave drives, further comprising means for respectively transmitting motion from the first and second slave drives to first and second movable parts of a cigarette packing machine, said first part including a first conveyor having receptacles for arrays of cigarettes and said second part including at least one second conveyor having means for advancing cigarettes from at least one magazine of the machine into the receptacles of the first conveyor.

25. The apparatus of claim 11 for controlling the operation of a driving system having first, second and third slave drives, further comprising means for respectively transmitting motion from the first, second and third slave drives to first, second and third movable parts of a cigarette packing machine, said first part comprising a first conveyor having receptacles for arrays of cigarettes, said second part comprising an indexible turret having pockets for arrays of cigarettes, said third part comprising a second conveyor having means for transferring arrays of cigarettes from the receptacles of the first conveyor into the pockets of said turret.

26. A method of controlling the operation of a driving system wherein at least one slave drive is normally operated at a predetermined speed and in a predetermined relation to and is electrically connected with a rotary main drive; comprising the steps of monitoring the angular position of the main drive; disconnecting the at least one slave drive from the driving system, including braking and thereupon arresting the at least one slave drive in predetermined angular positions of the main drive, said braking step comprising initiating a deceleration of the at least one slave drive from the predetermined speed in a first predetermined angular position of the main drive and said arresting step including bringing the at least one slave drive to a halt in a second predetermined angular position of the main drive; accelerating the arrested at least one slave drive to said predetermined speed; and reconnecting the thus accelerated at least one slave drive with the driving system.

27. Apparatus for controlling the operation of a driving system having at least one slave drive which is normally operated at a predetermined speed by and in a predetermined relation to and is electrically connected with a rotary main drive, comprising signal generating means for monitoring the angular position of the main drive; means for memorizing signals denoting first and second predetermined angular positions of the main drive; means for disconnecting the at least one slave drive from the driving system including means for braking and for thereupon arresting the at least one slave drive in a preselected position in predetermined angular positions of the main drive; means for accelerating the arrested at least one slave drive to said predetermined speed; means for reconnecting the thus accelerated at least one slave drive with the driving system; and means for comparing signals denoting the monitored angular position of the main drive with the signal denoting said first predetermined angular position and for generating additional signals when a signal denoting the monitored angular position of the main drive matches the signal denoting said first predetermined angular position of the main drive, said disconnecting means comprising a control unit having means for braking the at least one slave drive in response to an additional signal from said comparing means and for arresting the at least one slave drive in said preselected position when the monitored angular position of the main drive matches said memorized second angular position.

* * * * *